US005954181A

United States Patent [19]

Schwarzli

[11] Patent Number: 5,954,181

[45] Date of Patent: Sep. 21, 1999

[54] COIN MECHANISM WITH MAGNETIC LOCKING SYSTEM

[76] Inventor: Josef W. Schwarzli, 3927 Vandorf Road, Stouffville, Ontario, Canada, L4A 7X5

[21] Appl. No.: 08/949,098

[22] Filed: Oct. 10, 1997

[51] Int. Cl.[6] ..... G07F 5/02

[52] U.S. Cl. ..... 194/324

[58] Field of Search ..... 194/320, 321, 194/322, 323, 324, 325

[56] References Cited

U.S. PATENT DOCUMENTS

| | | | |
|---|---|---|---|
| 1,180,713 | 4/1916 | Grover et al. | 194/320 |
| 1,838,907 | 12/1931 | DaGrenier | 195/322 |
| 2,091,232 | 8/1937 | Vogel et al. | 194/320 |
| 4,715,223 | 12/1987 | Kaiser et al. | 73/163 |
| 5,509,521 | 4/1996 | Bolen | 194/325 X |
| 5,609,235 | 3/1997 | Schwarzli | 194/320 |

FOREIGN PATENT DOCUMENTS

| | | | |
|---|---|---|---|
| 0 762 346 A3 | 6/1998 | European Pat. Off. | G07F 3/02 |
| 420765 | 5/1934 | United Kingdom . | |
| 1495070 | 12/1977 | United Kingdom . | |

*Primary Examiner*—F. J. Bartuska

*Attorney, Agent, or Firm*—Dimock Stratton Clarizio; Mark B. Eisen

[57] ABSTRACT

A coin mechanism is provided with a magnetic system for preventing rotation of a coin mechanism intended for use with a magnetic coin when a non-magnetic coin or token is deposited into the mechanism, and for preventing rotation of a coin mechanism intended for use with a non-magnetic coin when a magnetic coin or token is deposited into the mechanism. A magnet is lodged in the arm of a rocker which is biased away from the coin recess in the coin conveyor. The attractive force of the magnet on a magnetic coin or token inserted into the coin recess overcomes the force biasing the rocker arm, causing the rocker arm to move toward the coin or token. In a coin mechanism intended to accept a magnetic coin this causes a latch on the rocker arm to retract from a rotating member, allowing the rotating member to rotate and thus allowing the mechanism to operate; in a coin mechanism intended to accept a non-magnetic coin this causes a latch on the rocker arm to engage the rotating member, preventing the rotating member from rotating and thus preventing the mechanism from operating.

21 Claims, 10 Drawing Sheets

COIN MECHANISM WITH MAGNETIC LOCKING SYSTEM

FIELD OF INVENTION

This invention relates to coin mechanisms for vending machines. In particular, this invention relates to a coin mechanism for a bulk vender or other apparatus, having a magnetic coin release system that in one embodiment prevents the mechanism from turning if a magnetic coin is deposited into the mechanism, and in a further embodiment prevents the mechanism from turning if a non-magnetic coin is deposited into the mechanism.

BACKGROUND OF THE INVENTION

Rotary coin mechanisms are widely used in merchandise-dispensing machines such as bulk venders for dispensing gum balls and other small articles. Bulk venders are designed for self service by users with minimal maintenance, and as such are frequently placed in locations where their use cannot be readily supervised. As a result bulk venders are constantly subjected to attempts to steal merchandise, usually by children and adolescents.

One common type of theft from bulk venders involves the use of "slugs" approximating the size of the coin which the coin mechanism is designed to accept. This has led to the development of measuring devices with fairly precise tolerances, capable of determining the thickness and diameter of the inserted coin to within a few thousandths of an inch.

While in the past slugs were commonly cut or stamped out of sheet metal, more recently slugs composed of plastic or sturdy cardboard have also become popular due to their low cost and the ease with which such slugs can be produced to the required size. Cardboard slugs present a particular problem in bulk venders, because repeated attempts to force the mechanism to turn with an oversized cardboard slug in the coin recess can result in gradual wearing away of the edge of the slug until the edge has worn to a size within the tolerance of the measuring dog, at which point the mechanism will accept the slug.

A further problem is raised by the use of coins belonging to currency from other countries which may have a lower relative value than a coin of the intended denomination, but which coincidentally approximate the size and shape of the intended coin. In some cases such coins can be used in place of the intended coin, which similarly results in losses to bulk vender operators.

In some instances the coin intended to be accepted by the coin mechanism is magnetic. It is desirable in such cases to provide a system for preventing the mechanism from turning unless the deposited coin is magnetic, so that plastic or cardboard slugs, and non-magnetic coins from a foreign currency, will not be accepted by the coin mechanism even if they are of the correct size.

In other instances the coin intended to be accepted by the coin mechanism is not magnetic. It is desirable in such cases to provide a system for preventing the mechanism from turning unless the deposited coin is non-magnetic, so that steel slugs, magnetic tokens, and magnetic coins from a foreign currency will not be accepted by the coin mechanism even if they are of the correct size.

It is particularly desirable to provide a system which can be readily adapted for either of these situations using substantially the same components.

SUMMARY OF THE INVENTION

The present invention addresses these problems by providing a coin mechanism for a bulk vender which provides a magnetic release system that can be adapted, in a magnetic coin embodiment, for use in a mechanism intended to accept a magnetic coin, or, in a non-magnetic coin embodiment, for use in a mechanism intended to accept a non-magnetic coin. In the magnetic coin embodiment plastic and cardboard slugs, metal slugs containing no magnetic component and non-magnetic coins from other currencies cannot be used to operate the coin mechanism. In the non-magnetic coin embodiment slugs containing steel and magnetic coins from other currencies cannot be used to operate the coin mechanism. This is accomplished in the invention without interfering with existing security features such as coin measuring devices, and as such provides an additional method of discriminating between coins of the intended denomination and other coins or slugs. Further, in the preferred embodiments this is accomplished by the invention using the same basic components for both embodiments, with only minor adaptation required for each embodiment.

The invention accomplishes this by providing a rocker having a magnetized arm which is biased away from the coin recess or other receptacle into which a coin is deposited to operate the mechanism.

In the first embodiment, herein referred to as the "magnetic coin embodiment", in the biased position a latch on the magnetized rocker arm impinges into the rotational path of a rotating member, preventing the rotating member from rotating and thus preventing the coin mechanism from rotating and dispensing merchandise. When a magnetic coin is deposited into the coin recess, the magnetized rocker arm moves toward the coin by magnetic attraction, and thus moves away from the rotating member, retracting the latch and freeing the rotating member which allows the mechanism to rotate through its dispensing cycle.

In the second embodiment, herein referred to as the "non-magnetic coin embodiment", the magnetized rocker arm does not have a latch and in the biased position does not interfere with rotation of the rotating member or the coin mechanism. When a magnetic coin or slug is deposited into the coin recess the magnetized rocker arm moves toward the coin or slug by magnetic attraction and thus moves away from the rotating member, which causes an opposing arm on the opposite side of the rocker fulcrum to move toward the rotating member. In this embodiment the opposing arm is provided with a latch, which thus impinges into the rotational path of a recess or opening in the rotating member and prevents the rotating member from rotating, thus preventing the coin mechanism from being rotated and dispensing merchandise so long as the magnetic coin or slug remains in the coin recess.

The present invention thus provides a coin mechanism comprising a stationary frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a rotating member spaced from the coin conveyor and rotationally engaged thereto, a movable rocker comprising a magnetized arm and a latch, mounted between the coin conveyor and the rotating member in rotationally fixed relation to the stationary frame, the rocker being movable between a locked position in which the latch impinges into the rotational path of the rotating member to substantially prevent rotation of the rotating member, and an unlocked position in which the latch is retracted from the rotational path of the rotating member to permit rotation of the rotating member, the magnetized arm being biased toward the rotating member by a biasing force when the coin conveyor is in the rest position, whereby when a magnetic coin or token is deposited into the coin receiving portion, an attractive force of the magnetized arm on the coin or token is sufficient to overcome the biasing force and draw the magnetized arm toward the coin or token causing the latch to either impinge into the rotational path of the rotating member or retract out of the rotational path of the rotating member.

The present invention further provides a coin mechanism comprising a stationary frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a rotating member spaced from the coin conveyor and rotationally engaged thereto, comprising a disc having an opening or recess into which a latch engages to lock the rotating member against rotation, a movable rocker comprising a magnetized arm with a latch, mounted between the coin conveyor and the rotating member in rotationally fixed relation to the stationary frame, the rocker being movable between a locked position in which the latch impinges into the rotational path of the rotating member to substantially prevent rotation of the rotating member, and an unlocked position in which the latch is retracted from the rotational path of the rotating member to permit rotation of the rotating member, the magnetized arm being biased toward the rotating member by a biasing force when the coin conveyor is in the rest position, whereby when a magnetic coin or token is deposited into the coin receiving portion, an attractive force of the magnetized arm on the coin or token is sufficient to overcome the biasing force and draw the magnetized arm toward the coin or token causing the latch to retract out of the rotational path of the rotating member.

The present invention further provides coin mechanism comprising a stationary frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a rotating member spaced from the coin conveyor and rotationally engaged thereto, comprising a disc having an opening or recess into which a latch engages to lock the rotating member against rotation, a movable rocker comprising a magnetized arm having a fulcrum and an opposing arm disposed on the opposite side of the fulcrum from the magnetized arm, mounted between the coin conveyor and the rotating member in rotationally fixed relation to the stationary frame, the rocker being movable between a locked position in which the latch impinges into the rotational path of the rotating member to substantially prevent rotation of the rotating member, and an unlocked position in which the latch is retracted from the rotational path of the rotating member to permit rotation of the rotating member, the magnetized arm being biased toward the rotating member by a biasing force when the coin conveyor is in the rest position, whereby when a magnetic coin or token is deposited into the coin receiving portion, an attractive force of the magnetized arm on the coin or token is sufficient to overcome the biasing force and draw the magnetized arm toward the coin or token causing the latch to impinge into the rotational path of the rotating member.

BRIEF DESCRIPTION OF THE DRAWINGS

In drawings which illustrate by way of example only a preferred embodiment of the invention.

DETAILED DESCRIPTION OF THE INVENTION

Figure 1:
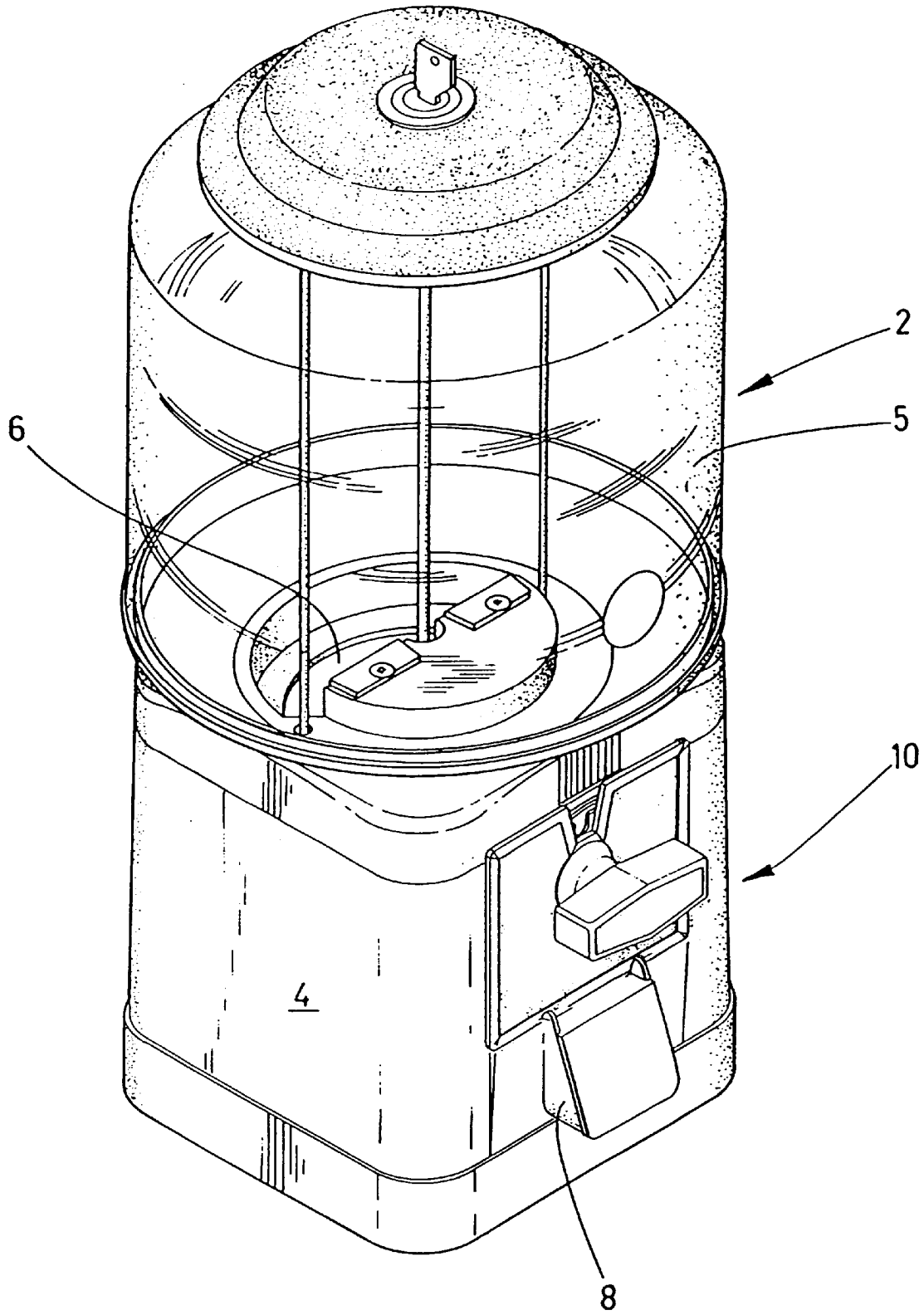
FIG. 1 is a perspective view of a bulk vender embodying the coin mechanism of the invention.

FIG. 1 illustrates a merchandise-dispensing apparatus commonly known as a bulk vender 2 in which the coin mechanism 10 of the invention may be employed. The vender 2 conventionally includes a lower housing 4 enclosing the workings of the coin mechanism and a cash box (not shown) for collecting deposited coins or tokens 1, a transparent article storage bin 5 for storing merchandise such as gum balls or other articles to be dispensed, and a turntable 6 which is rotated by rotation of the coin mechanism 10 to align one of a plurality of product carriers with the opening to a dispensing chute 8, as is well known.

It will be understood that although the invention will be described with reference to a coin, the term "coin" as used herein includes coins and tokens and like elements and is in no way restricted to currency or coins having a monetary value. It will also be understood that the coin mechanism of the invention may be used in other types of coin-operated apparatus which do not necessarily dispense merchandise, for example parking meters, and the invention is not restricted to any particular application of the coin mechanism 10.

As will be well known to those skilled in the art, a conventional coin mechanism for a bulk vender 2 consists of a rotating portion which rotates within a stationary frame.

The rotating portion comprises a handle 30 fixed to a tapered shaft 32 which extends through and engages the coin conveyor 40 through opening 38. The shaft 32 has a longitudinal flat (or slightly concave) surface 32*a* to rotationally engage the coin conveyor 40, and terminates at a squared end 32*a* which engages into a square recess 64*a* formed in the drive gear 64. Thus, rotation of the handle 30 is transmitted through the shaft 32 to the drive gear 64, to rotate the turntable 6 and dispense merchandise to the user.

Figure 4:
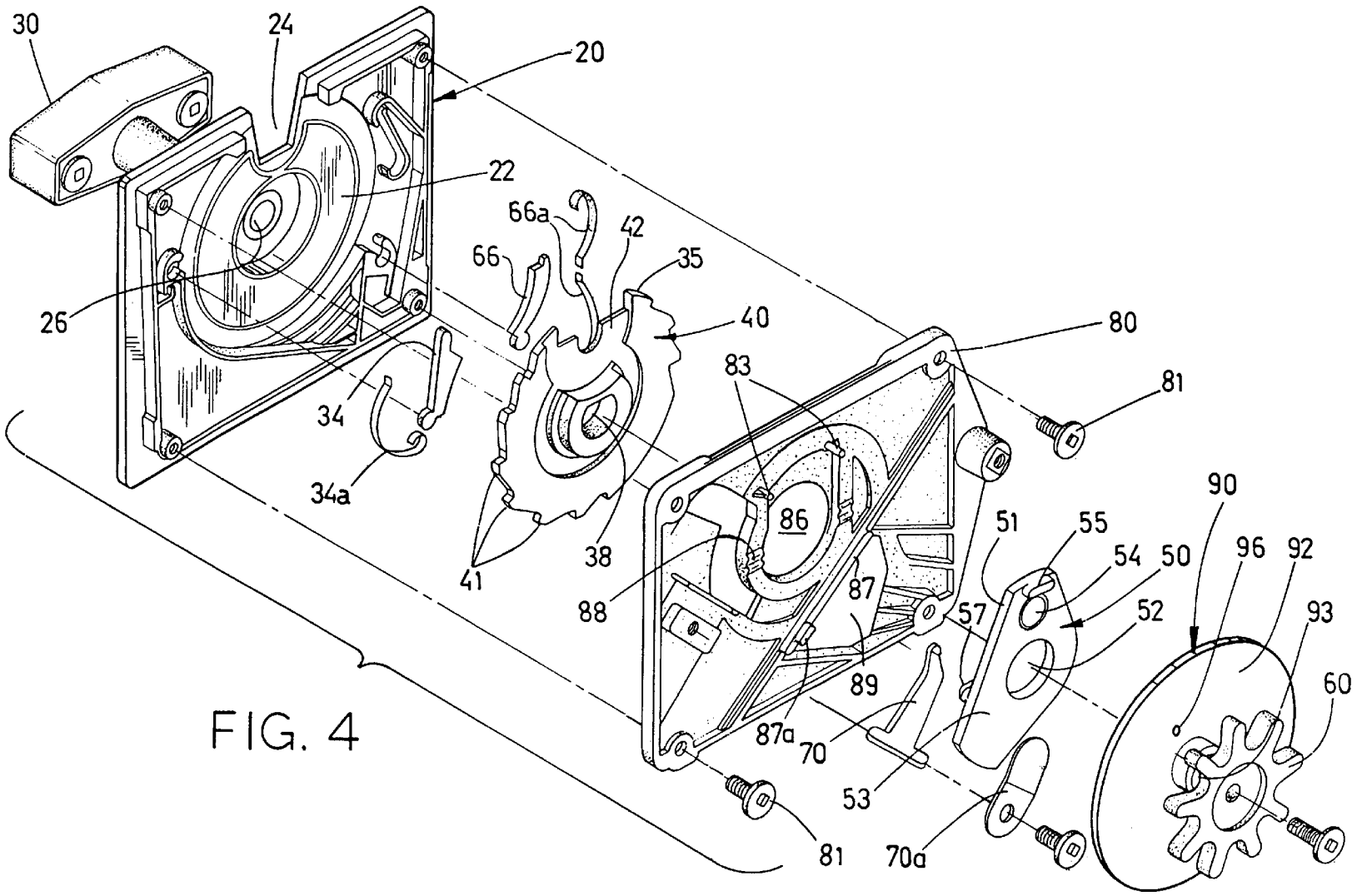
FIG. 4 is an exploded perspective view of a magnetic coin embodiment of the invention.
Figure 7:
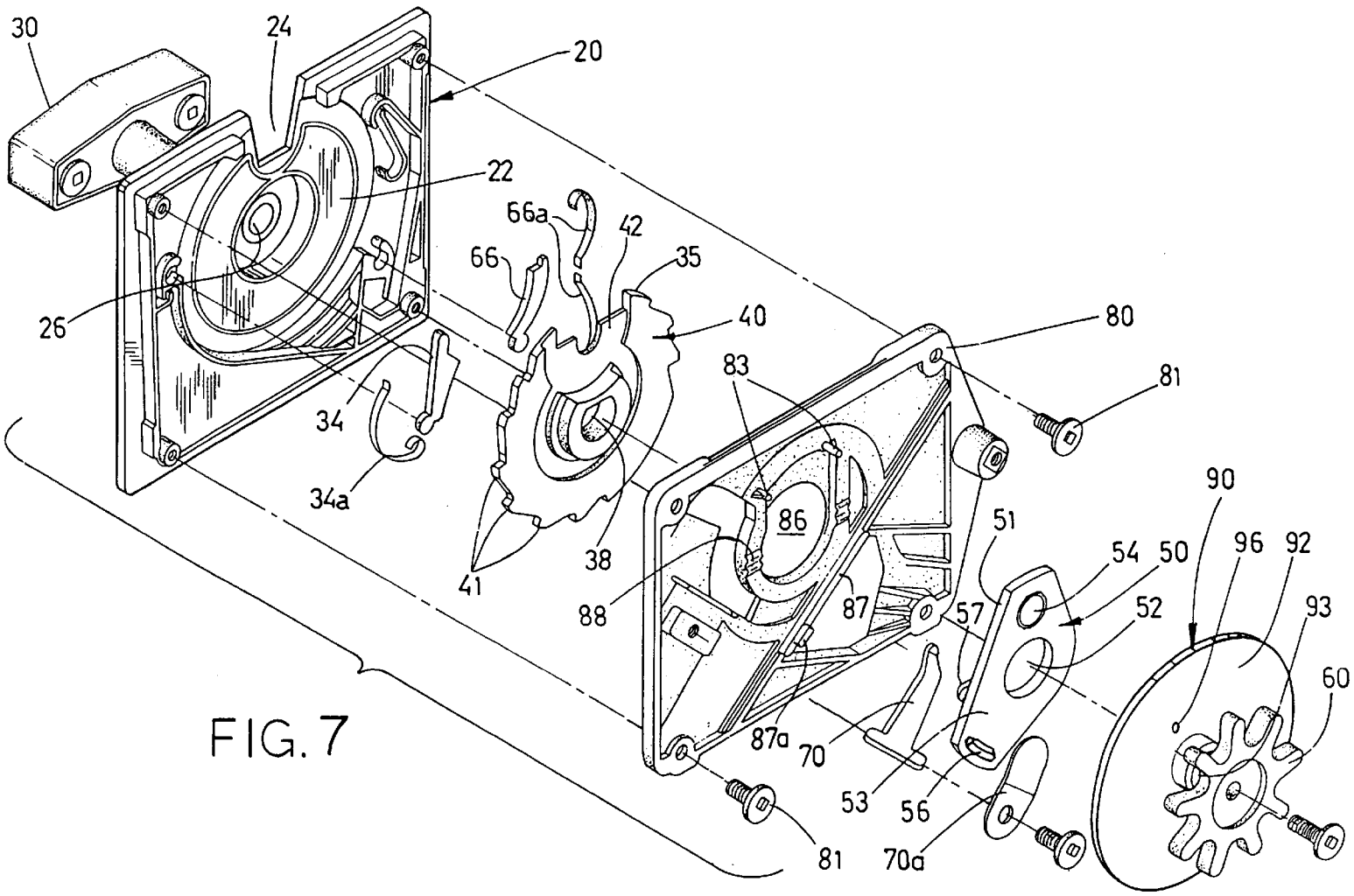
FIG. 7 is an exploded perspective view of a non-magnetic coin embodiment of the invention.

The stationary frame comprises a cover plate 20 and a back plate 80. The cover plate 20 is provided with a coin opening 24 through which a coin is deposited to operate the mechanism, and typically has a circular recess 22 in its rear face (for example as shown in FIGS. 4 and 7) in which the coin conveyor 40 rotates, with an opening 26 centered in the recess 22 through which the shaft 32 extends into the mechanism. The back plate 80 overlays the coin conveyor 40 and is affixed to the cover plate 20 so as to be stationary relative thereto, as by bolts 81. The back plate 80 retains a coin 1 in the coin recess 42 along the rotational path followed by the coin 1 as the mechanism is rotated. Thus, the cover plate 20 and back plate 80 remain stationary, fixed to the vender 2 or other coin-operated apparatus, while the coin conveyor 40 and gear 64 are rotationally engaged to the shaft 32 and rotate as the handle 30 is turned.

The coin conveyor 40 includes a coin receiving portion for receiving a coin 1, which in the embodiment shown comprises a coin recess 42 in which the coin 1 nests as it is conveyed about the rotational cycle of the coin mechanism. The coin recess 42 is dimensioned to the size of the intended coin 1, so that larger coins cannot be deposited into the mechanism. The coin receiving portion of the coin conveyor 40 may additionally (or alternatively) comprise a pair of spaced apart pins 42*a*, a ledge (not shown) or any other means capable of supporting a coin 1.

In the illustrated embodiment the coin conveyor 40 is provided with peripheral ratchet teeth 41, which cooperate with a pawl 66 biased against the teeth 41 by springs 66*a* to prevent reverse rotation of the mechanism 10 during most of the dispensing cycle. A separate gear could equally be used for this purpose.

The illustrated coin mechanism includes measuring devices for measuring the thickness and diameter of a coin deposited into the coin recess 42. A dog 70 for measuring the thickness of a coin 1 is mounted on the back plate 80 biased against the coin recess 42 by a spring 70*a*, and catches the trailing edge of the coin recess 42 if an inserted coin or slug is thinner than the intended coin 1, to arrest rotation of the mechanism. Another dog 34 for measuring the diameter of the coin 1 is mounted on the cover plate 20 biased against the coin conveyor 40 by a spring 34*a*, and catches the trailing outer corner 35 of the coin recess 42 if an inserted coin or slug does not have the correct diameter, to arrest rotation of the mechanism.

The coin mechanism described thus far will be well known to those skilled in the art. The coin mechanism 10 of the present invention, preferred embodiments of which are illustrated in FIGS. 2 to 8, introduces a magnetic system for preventing rotation of the mechanism 10 in two main embodiments:

i) In the case of a mechanism 10 intended to accept a magnetic coin 1, the invention prevents rotation of the mechanism 10 unless a magnetic coin is deposited into the coin recess 42. As defined herein a coin is a magnetic coin if it contains a sufficient quantity of a magnetic substance, such as iron, as to enable a magnet 54 to exert an attractive force on the coin. This embodiment is referred to herein as the "magnetic coin embodiment".

ii) In the case of a mechanism 10 intended to accept a non-magnetic coin 1, the invention prevents rotation of the mechanism 10 if a magnetic coin is deposited into the coin recess 42. This embodiment is referred to herein as the "non-magnetic coin embodiment". As defined herein a coin is a non-magnetic coin if it does not contain a sufficient quantity of a magnetic substance as to enable a magnet 54 to exert an attractive force on the coin.

Figure 13:
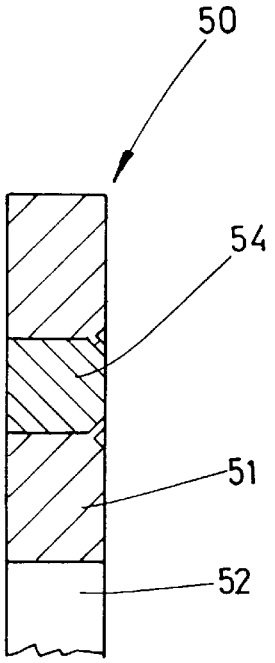
FIG. 13 is an enlarged cross-section of the magnetized rocker arm showing a preferred manner of mounting a magnet therein.

In both of these embodiments the invention comprises a movable rocker 50 rotationally fixed relative to the stationary frame, so that the rocker 50 can move axially but does not rotate with the shaft 32. The rocker 50 comprises an arm 51 provided with a magnetized element such as a disc magnet 54 which is embedded in a hole in the arm 51 disposed in the vicinity of the coin recess 42 when the mechanism 10 is in the rest position, preferably so as to be flush with the front and rear faces of the arm 51. The magnet 54 may be a permanent magnet or an electromagnet. The magnet 54 may be affixed in place by clinching around the periphery of the hole, as shown in FIG. 13, or alternatively by epoxy or any other suitable adhesive or other means. The arm 51 is hereinafter be referred to as the "magnetized arm" due to the magnetic attraction provided by the magnet 54 mounted therein.

Figure 11:
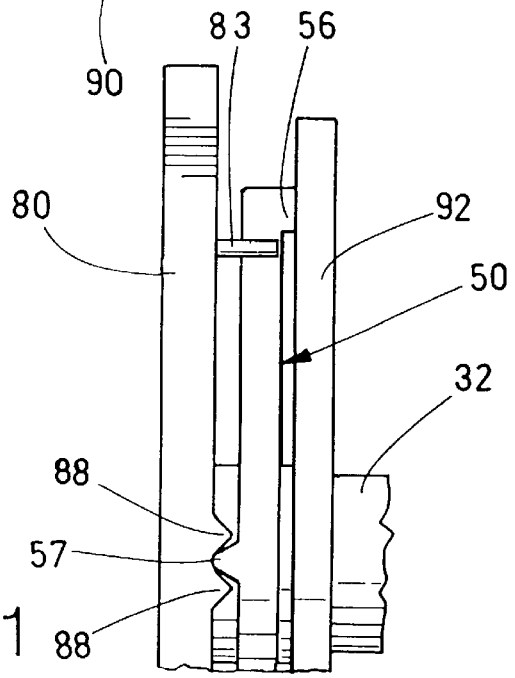
FIG. 11 is a side elevation of the coin conveyor and rotating member showing a preferred manner of mounting the rocker.

In the preferred embodiment the rocker 50 is mounted on the back plate 80. The back plate 80 is thus provided on both sides of the opening 86 with pairs of ribs 88 between which one or more projections 57 are seated, as shown in FIG. 11. Preferably the depth of the projections 57 is such that when the rocker 50 is mounted about the shaft 32 the opening 52 is substantially centered in the space between the back plate 80 and the rotating member 90.

In the preferred embodiment the rocker opening 52 is mounted about the hub 97 of a latch plate 92, described below, to resist displacement of the rocker 50, but the opening 52 is sufficiently larger than the hub 97 so as not to interfere with rotation of the shaft 32 or the rocking motion of the rocker 50. The arm 51 thus moves toward and away from the coin conveyor 40 (with the back plate 80 interposed therebetween), pivoting on the projections 57 which form a fulcrum and space the rocker 50 from the back plate 80 so the rocker 50 can pivot between the locked and unlocked positions.

Because both the projections 57 and the ribs 88 are preferably rounded to facilitate free axial movement of the rocker 50, in the preferred embodiment resistance to rotation of the rocker 50 is reinforced by a pair of bosses or pins 83 extending from the back plate 80 which abut the side edges of the rocker 50 to prevent any rotation, ie. to maintain the rocker 50 oriented in a rotationally fixed position relative to the stationary frame. It will nevertheless be appreciated that the projections 57 nesting between the ribs 88 will provide some degree of resistance to rotation of the rocker 50, and as such it may not be necessary to mount the rocker 50 about the shaft 32 or to provide pins 83 functioning to prevent rotation of the rocker 50. It will also be apparent that the rocker 50 could instead be hinged to the back plate 80 or in some other manner fixed in position so as to be rotationally stationary but axially movable, and the invention is not intended to be so restricted.

The rocker 50 is provided with a latch which cooperates with a rotating member 90 engaged to the shaft 32, to prevent the shaft 32 from being turned when the rocker 50 is in the locked position. In the preferred embodiment the rotating member 90 comprises a disc-shaped latch plate 92, engaged to the shaft 32 at opening 93 so as to rotate with the shaft 32 as the handle 30 is turned.

Figure 5:
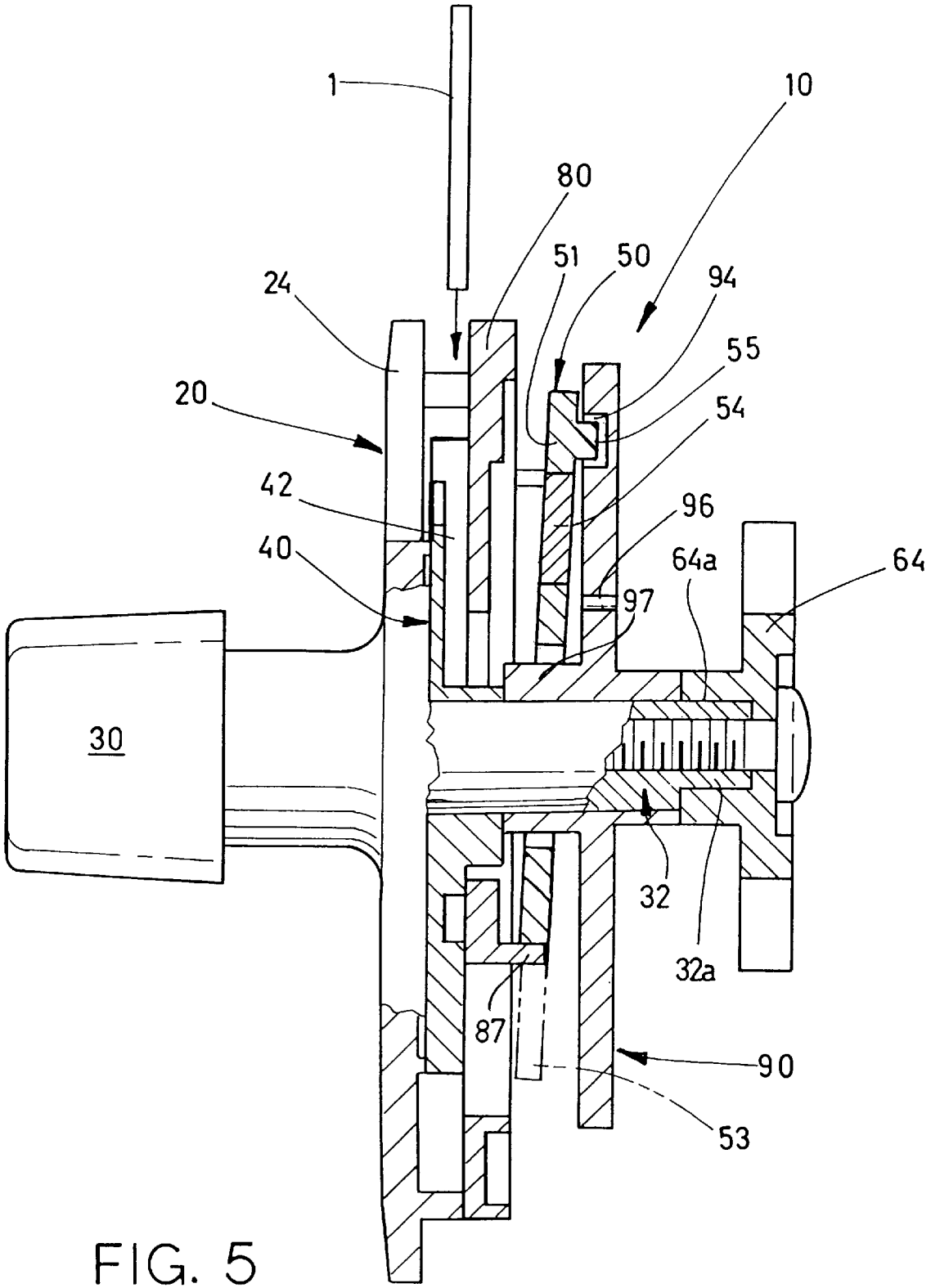
FIG. 5 is a side elevation of the coin mechanism of FIG. 4 partly in cross-section, showing the rocker in a locked position.
Figure 8:
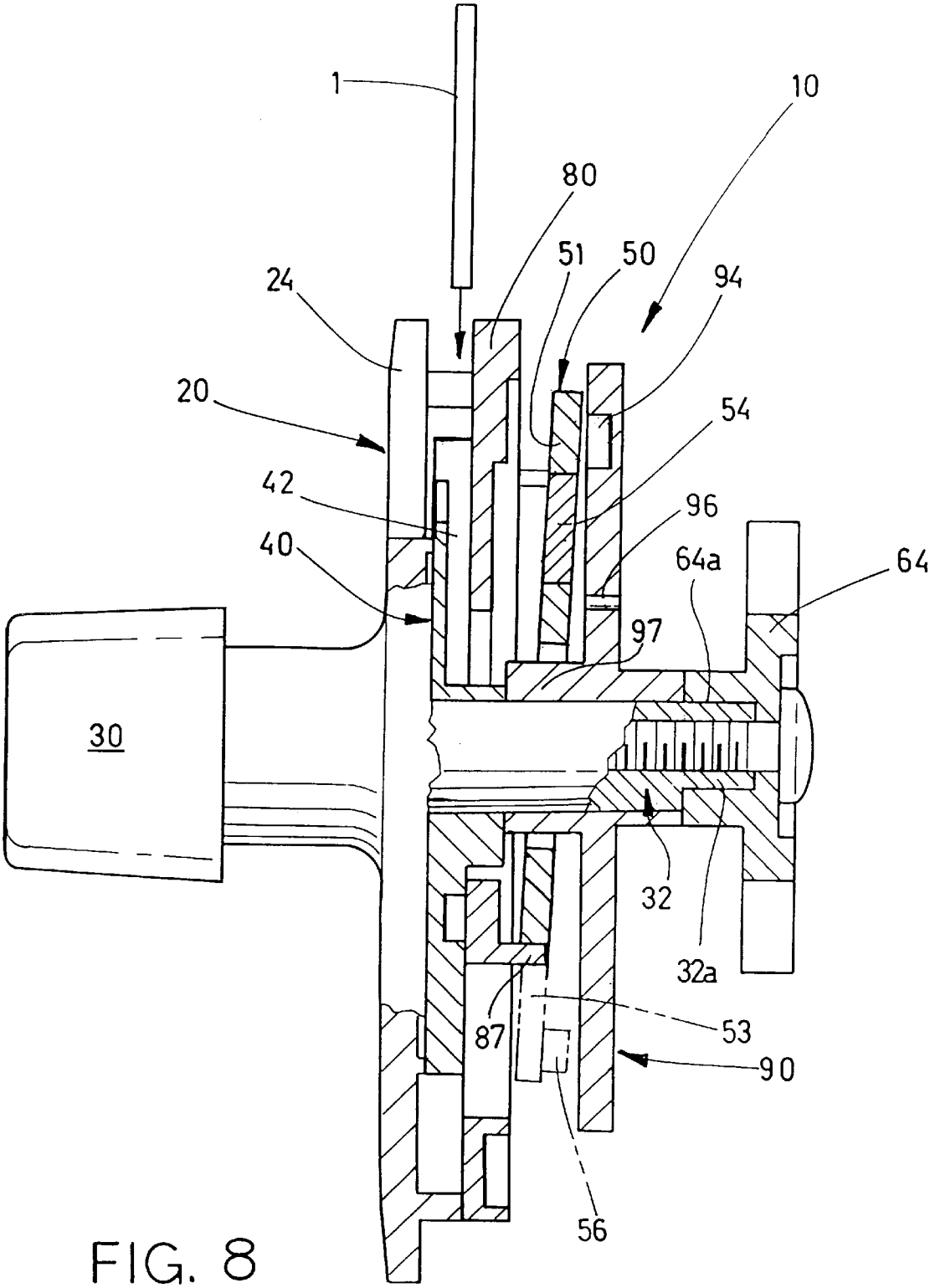
FIG. 8 is a side elevation of the coin mechanism of FIG. 7 partly in cross-section, showing the rocker in an unlocked position.

The magnetized arm 51 is biased toward the latch plate 92, in the preferred embodiment by a magnetic mass 96 such as a steel pin 96 or the like lodged in the latch plate 92 near the position of the magnet 54 when the mechanism 10 is in the rest position shown in FIGS. 5 and 8. A magnetic coin 1 deposited into the coin recess 42 will overcome the attractive force of the magnet 54 on the pin 96 and cause the rocker 50 to move, so that the magnetized arm 51 moves toward the coin 1 in the coin recess 42.

Figure 10:
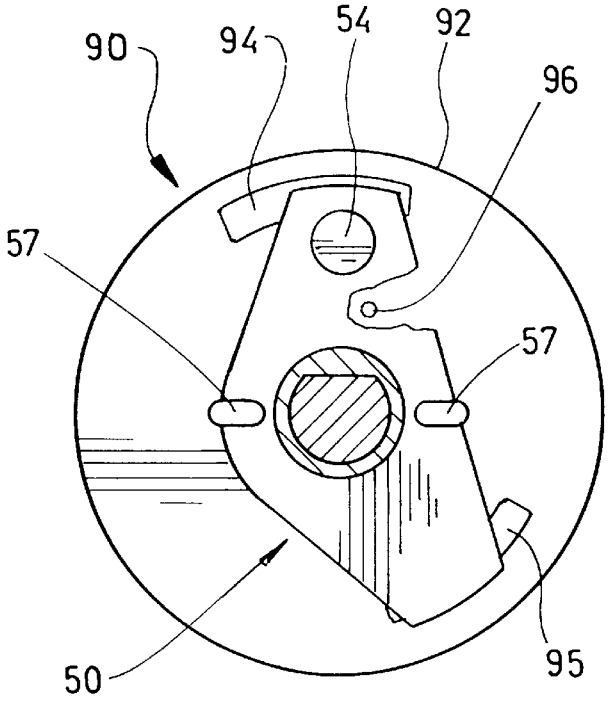
FIG. 10 is a front elevation of the rocker and rotating member.

In order to ensure that the rocker 50 will move under the force of magnetic attraction exerted by the magnet 54 on a magnetic coin 1, the magnetic pin 96 is made significantly smaller than the magnetic component of a magnetic coin. Preferably the pin 96 is positioned in the latch plate 92 offset from the axis of the magnet 54, for example slightly beneath and laterally off center as shown in FIG. 10, so that the magnet 54 never approaches too close to the magnetic pin 96. A biasing force for biasing the rocker 50 to the locked position may alternatively be supplied by a resilient element, such as a spring, rubber block or filament etc. (not shown), so long as the biasing force is less than the attractive force exerted by the magnet 54 on a magnetic coin 1 seated in the coin recess 42.

It will be appreciated that the back plate 80, being disposed between the coin recess 42 and the magnet 54, must be formed from a non-magnetic material so that it does not interfere with the magnetic attraction of the magnet 54 on a magnetic coin 1. In the preferred embodiment all of the components of the mechanism 10 (except for the magnet 54 and the magnetic pin 96) are cast or otherwise formed from aluminum or zinc so as to be non-magnetic. This is especially important for those components in the vicinity of the magnet 54.

As noted above the rotating member 90 cooperates with a latch projecting from the rocker 50 to arrest rotation of the mechanism 10 when the rocker 50 is in the locked position. However, the locked position of the rocker 50 differs, depending upon whether the mechanism 10 is intended to accept a magnetic coin or a non-magnetic coin.

Magnetic Coin Embodiment

Figure 6:
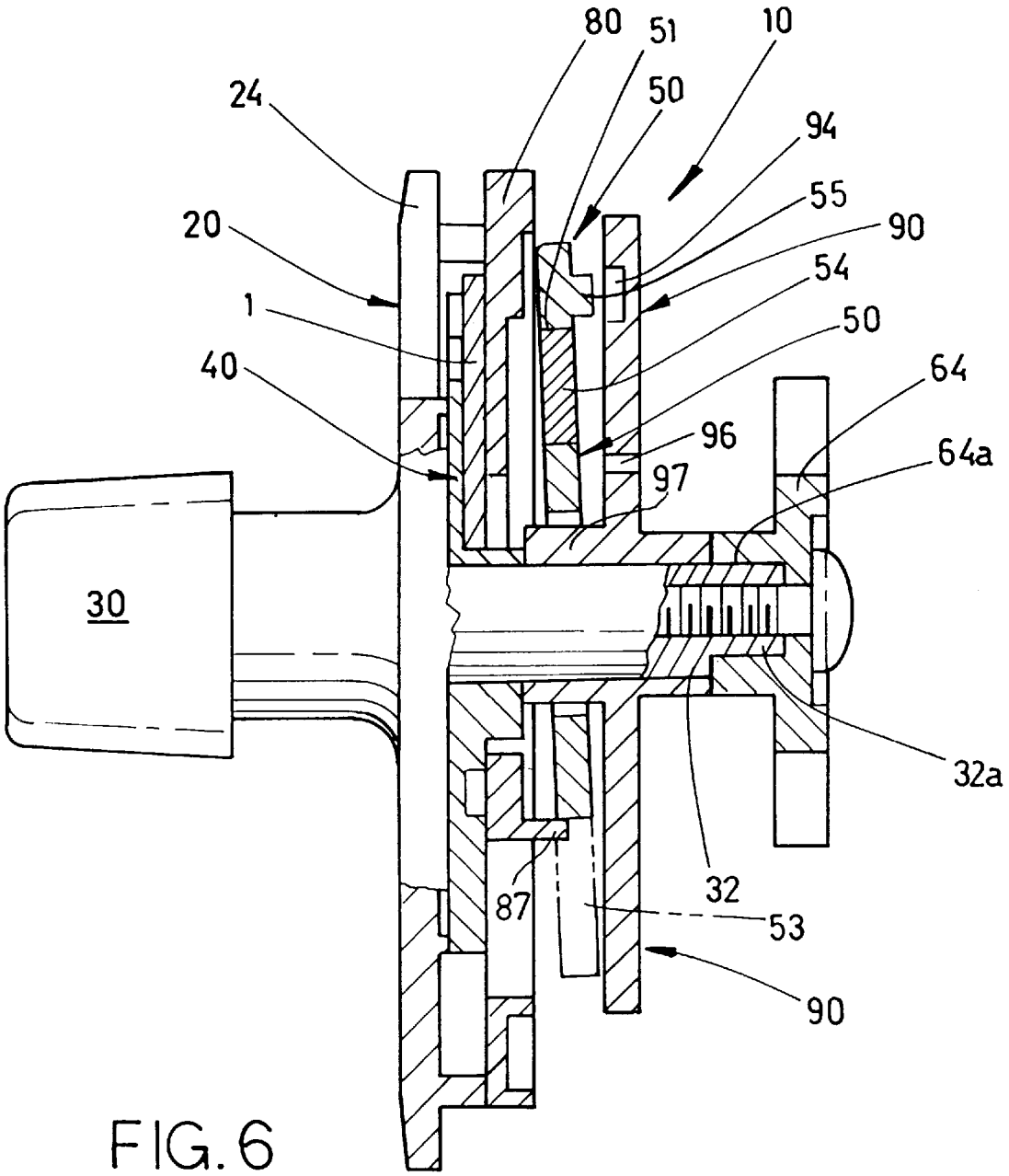
FIG. 6 is a side elevation of the coin mechanism of FIG. 4 partly in cross-section, showing the rocker in an unlocked position.

A preferred form of the magnetic coin embodiment is illustrated in FIGS. 4 to 6. The magnetized rocker arm 51 is provided with a latch 55 which projects in the direction of the latch plate 92. The latch plate 92 is provided with an opening or recess 94, best seen in FIG. 10, into which the latch 55 engages when the mechanism 10 is in the rest position.

Figure 2:
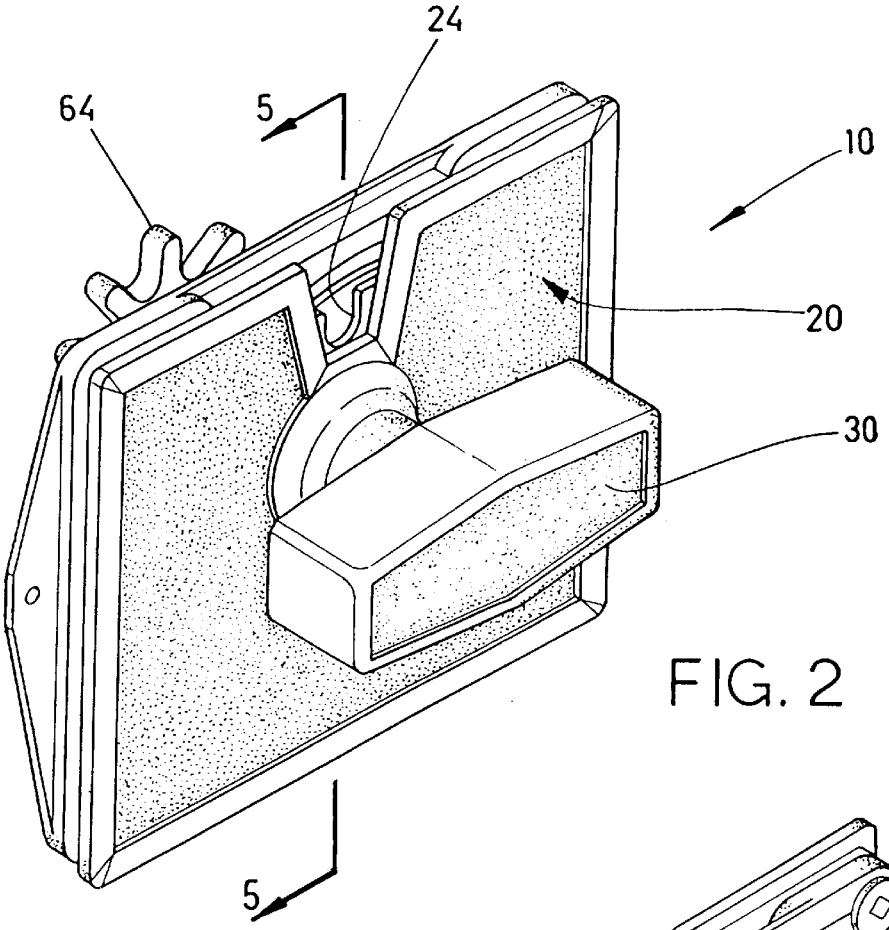
FIG. 2 is a front perspective view of a coin mechanism of the invention.
Figure 3:
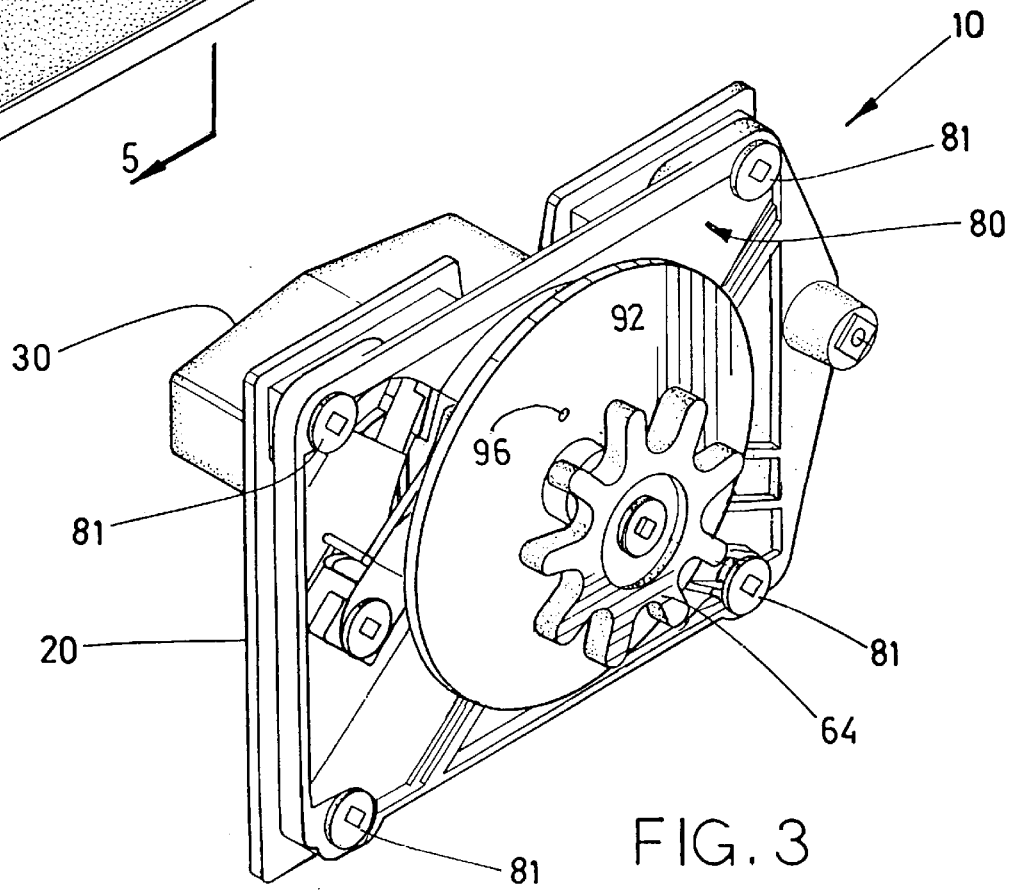
FIG. 3 is a rear perspective view of the coin mechanism of FIG. 2.

In use the mechanism 10 starts in the rest position shown in FIGS. 2 and 5, with the coin recess 42 in alignment with the coin opening 24 in the cover plate 20. In this position the magnet 54 is attracted to the magnetic pin 96 lodged in the latch plate 92, so the magnetized arm 51 is drawn toward the latch plate 92 and the rocker 50 is thus biased to the locked position, with the latch 55 engaging the recess 94 in the latch plate 92, as shown in FIG. 5. Because the rocker 50 is rotationally fixed to the stationary frame, the latch plate 92 is prevented from rotating so long as the latch 55 remains engaged in the recess 94; since the latch plate 92 is rotationally engaged to the shaft 32, the shaft 32 is similarly prevented from rotating and the handle 30 cannot be turned.

When a magnetic coin 1 of the intended denomination is deposited through the coin opening 24 it nests in the coin recess 42 of the coin conveyor 40, as shown in FIG. 5. The coin 1 now being in close proximity to the magnet 54, the attractive force of the magnet 54 on the magnetic pin 96 is overcome by the attractive force of the magnet 54 on the magnetic coin 1, which has a significantly greater magnetic component. The magnetized arm 51 thus pivots toward the coin recess 42, retracting the latch 55 from the recess 94 and permitting the latch plate 92 to rotate, as shown in FIG. 6. This frees the shaft 32 and allows the handle 30 to be turned to the point in the rotational cycle where the measuring devices 34, 70 can measure the coin 1 to ensure that it is of the correct diameter and thickness. If the coin 1 is of the intended denomination, the measuring dogs 34, 70 will allow the mechanism 10 to be rotated through the dispensing cycle.

As the handle 30 is turned the gear 64 rotates the turntable 6 so that an opening in the turntable 6 comes into alignment with the dispensing chute 8 and dispenses merchandise to the user. The coin 1 is typically released from the mechanism 10 just beyond the halfway point in the rotational cycle of the mechanism 10, so that as the latch plate 92 returns to the rest position only the magnetic pin 96 is present to influence the magnet 54, so the rocker 50 is drawn back to the locked position and as the recess 94 comes back into alignment with the latch 55 the latch 55 re-engages the recess 94 under the attractive force of the magnet 54 on the magnetic pin 96.

If a non-magnetic coin or slug is deposited into the coin recess 42, the rocker 50 remains in the locked position with the latch 55 engaging the recess 94, and the mechanism 10 cannot be turned. It can be seen that in the magnetic coin embodiment the mechanism 10 will not operate if a non-magnetic coin or slug is deposited into the coin recess 42, regardless of the size of the coin or slug.

Non-Magnetic Coin Embodiment

Figure 9:
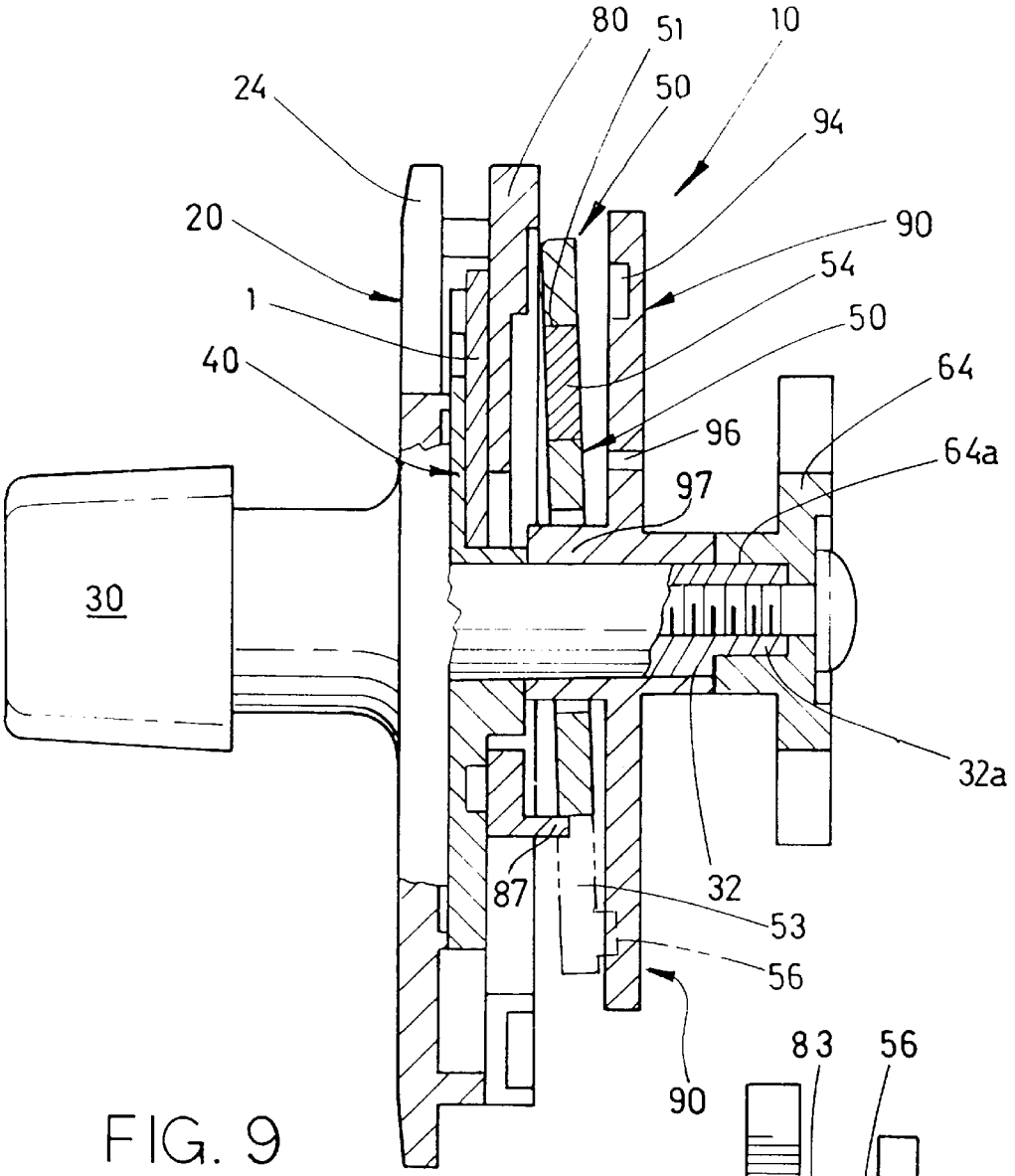
FIG. 9 is a side elevation of the coin mechanism of FIG. 7 partly in cross-section, showing the rocker in a locked position.

A preferred form of the non-magnetic coin embodiment is illustrated in FIGS. 7 to 9. In this embodiment the rocker 50 is provided with an opposing arm 53 which extends from the side of the fulcrum (projections 57) opposite to the magnetized arm 51. The opposing arm 53 need not extend in diametric opposition to the magnetized arm 51, so long as the opposing arm 53 is located on the opposite side of the fulcrum of the rocker 50 so that as the magnetized arm 51 moves in one axial direction the opposing arm 53 moves in the other axial direction. In the embodiment illustrated the opposing arm 53 is oriented at an oblique angle directed away from the coin ejection opening 89 in the back plate 80, so as not to interfere with the ejection of coins from the mechanism 10.

Figure 12A:
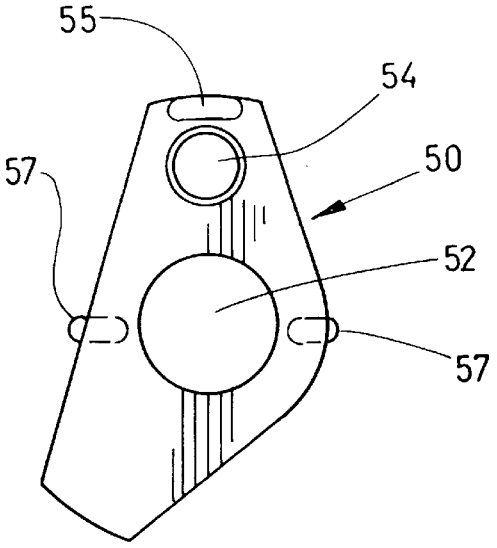
FIG. 12*a* is a rear elevation of the rocker with the latch milled off of the opposing arm for use in a magnetic coin embodiment of the invention.
Figure 12B:
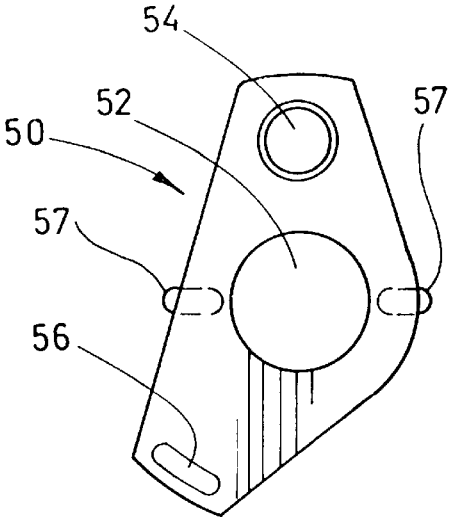
FIG. 12*b* is a rear elevation of the rocker with the latch milled off of the magnetized arm for use in a non-magnetic coin embodiment of the invention.

In the non-magnetic coin embodiment the recess or opening 94 in the latch plate 92 is not used. The latch 55 on the magnetized arm 51 is milled or filed off before the mechanism 10 is assembled, leaving only a latch 56 on the opposing arm 53 as shown in FIGS. 7 and 12*b*. The latch 56 projects in the direction of the latch plate 92, and the latch plate 92 is provided with an opening or recess 95, best seen in FIG. 10, with which the latch 56 is aligned when the mechanism 10 is in the rest position.

To provide further resistance to rotation of the rocker 50 in the non-magnetic coin embodiment, a raised rib 87 projects from the back plate 80 along the lower edge of the opposing arm 53, as shown in FIG. 7. The rib 87 may be provided with a boss 87*a* to ensure that the rocker 50 cannot be squeezed between the rib 87 and the latch plate 92 by the application of force to the handle 30. The rib 87 and boss 87*a* thus provide a stop surface against which the opposing arm 53 bears if the handle 30 is turned when the opposing arm 53 is in the locked position.

In use the mechanism 10 starts in the rest position shown in FIGS. 2 and 8, with the coin recess 42 in alignment with the coin opening 24 in the cover plate 20. In this position the magnet 54 is attracted to the magnetic pin 96 lodged in the latch plate 92 so the magnetized arm 51 is drawn toward the latch plate 92, which has the effect of drawing the opposing arm 53 away from the latch plate 92 and the rocker 50 is thus biased to the unlocked position, with the latch 56 retracted from the recess 95 in the latch plate 92, as shown in FIG. 8. The handle 30 is free to be turned to the point in the rotational cycle where the measuring devices 34, 70 measure a deposited coin.

If a non-magnetic coin 1 of the intended denomination is deposited through the coin opening 24 into the coin recess 42 the coin 1 does not influence the magnetized arm 51, which thus remains attracted to the magnetic pin 96, and the mechanism 10 can therefore be rotated past the measuring devices 34, 70 and through the dispensing cycle of the mechanism 10, in the same manner described above. As the magnetic pin 96 returns to the rest position it attracts the magnet 54 and retains the rocker 50 in the unlocked position.

If a magnetic coin or slug is deposited into the coin recess 42, the attractive force of the magnet 54 on the magnetic pin 96 is overcome by the attractive force of the magnet 54 on the magnetic coin or slug. The magnetized arm 51 thus pivots toward the coin recess 42, which has the effect of drawing the opposing arm 53 toward the latch plate 92, engaging the latch 56 into the recess 95 and arresting rotation of the latch plate 92, as shown in FIG. 9. The latch plate 92 is prevented from rotating so long as the rocker 50 remains in the locked position, with the latch 56 engaged in the opening or recess 95, and the shaft 32 is thus prevented from rotating so the handle 30 cannot be turned. It can be seen that in the non-magnetic coin embodiment the mechanism 10 will not operate if a magnetic coin or slug is deposited into the coin recess 42, regardless of the size of the coin or slug.

In the preferred embodiments of the invention, the coin mechanism 10 is designed to accommodate both the magnetic coin embodiment and the non-magnetic coin embodiment. The latch plate 92 is provided with both recesses 94 and 95. Likewise, both the magnetized arm 51 is provided with a latch 55 and the opposing arm 53 is provided with a latch 56; however in use one of the latches 55 or 56 must be removed before the rocker 50 is assembled into the coin mechanism 10. If the mechanism 10 is intended to accept magnetic coins, the latch 56 is filed or milled off of the opposing arm 53 so that the rocker 50 ends up being configured as shown in FIG. 12*a* when assembled into the mechanism 10. If the mechanism 10 is intended to accept non-magnetic coins, the latch 55 is filed or milled off of the magnetized arm 51 so that the rocker 50 ends up being configured as shown in FIG. 12*b* when assembled into the mechanism 10.

It will be noted that in the preferred embodiments the arms 51, 53 are formed to slightly different lengths and the latches 55, 56 are thus located at different radial positions. This allows the recesses 94, 95 to be located at different radial positions on the latch plate 92, which ensures that the latch 55 cannot inadvertently engage into the recess 95 in the magnetic coin embodiment, and conversely that the latch 56 cannot inadvertently engage into the recess 94 in the non-magnetic coin embodiment. This is desirable because once the coin conveyor 40 is rotated beyond the rest position, so that both a magnetic coin and the magnetic pin 96 are too far away from the magnet 54 to magnetically influence the rocker 50, the rocker 50 is not biased to either the locked or unlocked positions and can rock freely. The recesses 94 and 95 are therefore radially misaligned to ensure that each does not interfere with the operation of the mechanism 10 in the embodiment in which only the other recess 94 or 95 is intended to be used.

In the preferred embodiments it may be desirable to form the recesses 94, 95 in the latch plate 92 so that they are longer than the width of the respective latches 55, 56. This will allow some 'free play' in the handle 30, which can be beneficial for maintaining a uniform distribution of merchandise in the article storage bin 5 of the vender 2. Because of the placement of the ratchet teeth 41, the rest position is the only point in the rotational cycle at which the mechanism 10 can be turned in reverse (counter-clockwise in the embodiment shown), and even a slight reverse rotation helps to scatter merchandise about the article storage bin 5 enough to prevent local accumulation.

Figures 14, 15:
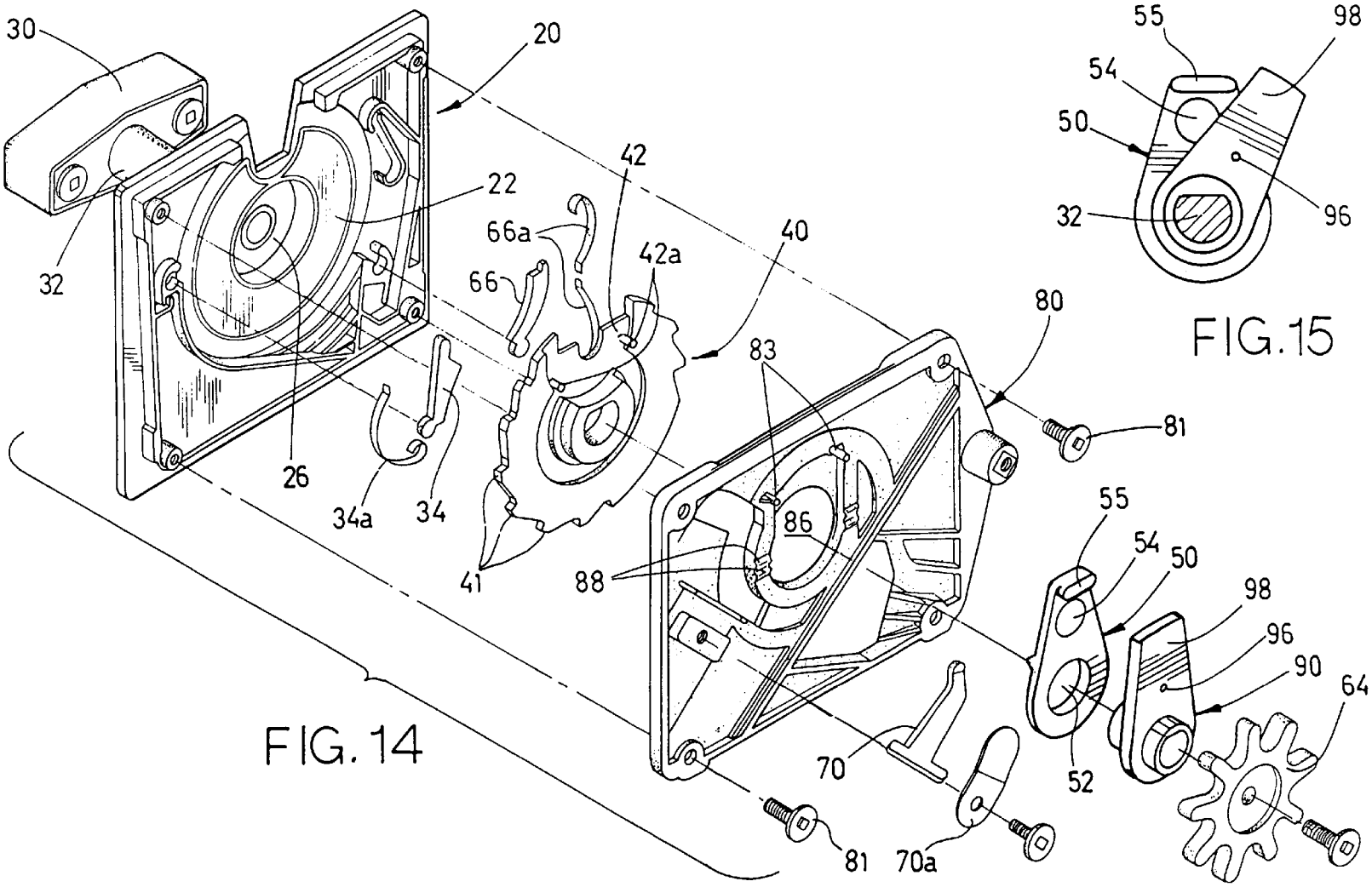
FIG. 14 is an exploded perspective view of a further magnetic coin embodiment of the coin mechanism of the invention.
FIG. 15 is a rear elevation of the rotating member and rocker in the coin mechanism of FIG. 14.

In the preferred embodiments described above the rotating member 90 is provided in the form of a latch plate 92, which avoids potential problems such as structural weakness and axial misalignment between the latches 55, 56 and the rotating member 90. However, it will be appreciated that the rotating member 90 could be any structure which rotates with the shaft 32 and cooperates with the latch 55 or 56 to arrest rotation of the mechanism 10, such as a rigid bar or finger 98 as shown in FIGS. 14 and 15, in which in the locked position the latch 55 or 56 projects into the rotational path of the bar 98.

It will also be appreciated that in the magnetic coin embodiment the opposing arm 53 is unnecessary, because the magnetized rocker arm 51 provides both the magnet 54 and the latch 55 which engages the latch plate 92 to prevent the mechanism 10 from rotating. It is expedient to provide the opposing arm 53 in this embodiment, so that a single configuration of rocker 50 can be used for both the magnetic coin embodiment and the non-magnetic coin embodiment. Also, to some degree the opposing arm 53 may act as a counterbalance which can render the motion of the rocker 50 somewhat more uniform. However, the magnetic coin embodiment will operate without the opposing arm 53, as in the embodiment illustrated in FIG. 14.

It can thus be seen that in the magnetic coin embodiment of the invention the coin mechanism 10 will not operate in response to non-magnetic coins and slugs. This considerably narrows down the range of coins and slugs which will be accepted by the coin mechanism 10, and eliminates the possibility of acceptance of cardboard and plastic slugs. Likewise, in the non-magnetic coin embodiment of the invention the coin mechanism 10 will not operate in response to magnetic coins and slugs, which considerably narrows down the range of coins and slugs which will be accepted by the coin mechanism 10, and eliminates the possibility of acceptance of magnetic coins from foreign currencies, steel washers etc.

The preferred embodiments of the invention thus provide a security feature which, independently of existing measuring devices, reduces the variety of coins and slugs which the coin mechanism 10 will accept, either by rejecting magnetic coins and slugs or by rejecting non-magnetic coins and slugs, depending upon whether the intended coin 1 is magnetic or non-magnetic. It is still desirable to provide other security features such as measuring devices to further discriminate between the intended coin 1 and other coins or slugs, which will operate in addition to the invention. However, by reducing the variety of coins and slugs which the coin mechanism 10 will accept, and particularly when used in conjunction with other security features such as conventional diameter- and thickness-measuring devices, the invention provides a means of significantly reducing instances of theft from a bulk vender 2 or other coin operated apparatus.

The invention having been thus described with reference to a preferred embodiment, it will be apparent to those skilled in the art that variations and modifications of the invention may be made without departing from the scope of the invention, as set out in the appended claims.

I claim:

1. A coin mechanism comprising a stationary frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a rotating member spaced from the coin conveyor and rotationally engaged thereto, a movable rocker comprising a magnetized arm and a latch, mounted between the coin conveyor and the rotating member in rotationally fixed relation to the stationary frame, the rocker being movable between a locked position in which the latch impinges into the rotational path of the rotating member to substantially prevent rotation of the rotating member, and an unlocked position in which the latch is retracted from the rotational path of the rotating member to permit rotation of the rotating member, the magnetized arm being biased toward the rotating member by a biasing force when the coin conveyor is in the rest position, whereby when a magnetic coin or token is deposited into the coin receiving portion, an attractive force of the magnetized arm on the coin or token is sufficient to overcome the biasing force and draw the magnetized arm toward the coin or token causing the latch to either impinge into the rotational path of the rotating member or retract out of the rotational path of the rotating member.

2. The mechanism of claim 1 in which the stationary frame includes a back plate mounted to the cover plate between the coin conveyor and the rocker.

3. The mechanism of claim 2 in which the rocker is maintained in rotationally fixed relation to the stationary frame by one or more pins projecting from the back plate and abutting the rocker.

4. The mechanism of claim 1 in which the rocker is mounted about the shaft.

5. The mechanism of claim 1 in which the rocker comprises a fulcrum and moves between the locked position and the unlocked position by rocking about the fulcrum.

6. The mechanism of claim 1 in which the rotating member comprises a disc comprising an opening or recess into which the latch engages to lock the rotating member against rotation.

7. The mechanism of claim 6 in which the latch extends from an outer end of the rocker.

8. The mechanism of claim 7 in which the recess is larger than the latch, permitting a slight rotation of the mechanism when the rocker is in the locked position.

9. The mechanism of claim 1 in which the magnetized arm is biased toward the rotating member by a magnetic mass lodged in the rotating member, which mass is sufficiently small that the attractive force exerted by the magnetized arm on the mass is less than the attractive force exerted by the magnetized arm on a magnetic coin or token.

10. The mechanism of claim 1 in which the coin receiving portion comprises a coin recess in the coin conveyor.

11. The mechanism of claim 1 in which the latch projects from the magnetized arm and impinges into the rotational path of the rotating member when the magnetized arm is biased toward the rotating member.

12. The mechanism of claim 1 in which the latch projects from an opposing arm disposed on the opposite side of a fulcrum from the magnetized arm and impinges into the rotational path of the rotating member when the magnetized arm is drawn toward the coin or token.

13. The mechanism of claim 1 in which the rocker is formed with a fulcrum, a magnetized arm having a latch disposed on one side of the fulcrum and an opposing arm having a latch disposed on the opposite side of the fulcrum, wherein one of the latches is removed from the rocker prior to assembly of the rocker into the mechanism.

14. An apparatus for dispensing merchandise having a coin mechanism as defined in claim 1.

15. A coin mechanism comprising a stationary frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a rotating member spaced from the coin conveyor and rotationally engaged thereto, comprising a disc having an opening or recess into which a latch engages to lock the rotating member against rotation, a movable rocker comprising a magnetized arm with a latch, mounted between the coin conveyor and the rotating member in rotationally fixed relation to the stationary frame, the rocker being movable between a locked position in which the latch impinges into the rotational path of the rotating member to substantially prevent rotation of the rotating member, and an unlocked position in which the latch is retracted from the rotational path of the rotating member to permit rotation of the rotating member, the magnetized arm being biased toward the rotating member by a biasing force when the coin conveyor is in the rest position, whereby when a magnetic coin or token is deposited into the coin receiving portion, an attractive force of the magnetized arm on the coin or token is sufficient to overcome the biasing force and draw the magnetized arm toward the coin or token causing the latch to retract out of the rotational path of the rotating member.

16. The mechanism of claim 15 in which the rocker is provided with a fulcrum and an opposing arm disposed on the opposite side of the fulcrum from the magnetized arm.

17. The mechanism of claim 15 in which the magnetized arm is biased toward the rotating member by a magnetic mass lodged in the rotating member, which mass is sufficiently small that the attractive force exerted by the magnetized arm on the mass is less than the attractive force exerted by the magnetized arm on a magnetic coin or token.

18. An apparatus for dispensing merchandise having a coin mechanism as defined in claim 15.

19. A coin mechanism comprising a stationary frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a rotating member spaced from the coin conveyor and rotationally engaged thereto, comprising a disc having an opening or recess into which a latch engages to lock the rotating member against rotation, a movable rocker comprising a magnetized arm having a fulcrum and an opposing arm disposed on the opposite side of the fulcrum from the magnetized arm, mounted between the coin conveyor and the rotating member in rotationally fixed relation to the stationary frame, the rocker being movable between a locked position in which the latch impinges into the rotational path of the rotating member to substantially prevent rotation of the rotating member, and an unlocked position in which the latch is retracted from the rotational path of the rotating member to permit rotation of the rotating member, the magnetized arm being biased toward the rotating member by a biasing force when the coin conveyor is in the rest position, whereby when a magnetic coin or token is deposited into the coin receiving portion, an attractive force of the magnetized arm on the coin or token is sufficient to overcome the biasing force and draw the magnetized arm toward the coin or token causing the latch to impinge into the rotational path of the rotating member.

20. The mechanism of claim 19 in which the magnetized arm is biased toward the rotating member by a magnetic mass lodged in the rotating member, which mass is sufficiently small that the attractive force exerted by the magnetized arm on the mass is less than the attractive force exerted by the magnetized arm on a magnetic coin or token.

21. An apparatus for dispensing merchandise having a coin mechanism as defined in claim 19.

* * * * *